US006876280B2

(12) United States Patent
Nakano

(10) Patent No.: US 6,876,280 B2
(45) Date of Patent: Apr. 5, 2005

(54) HIGH-FREQUENCY SWITCH, AND ELECTRONIC DEVICE USING THE SAME

(75) Inventor: Hiroyuki Nakano, Yasu-gun (JP)

(73) Assignee: Murata Manufacturing Co., Ltd. (JP)

( * ) Notice: Subject to any disclaimer, the term of this patent is extended or adjusted under 35 U.S.C. 154(b) by 102 days.

(21) Appl. No.: 10/601,799

(22) Filed: Jun. 23, 2003

(65) Prior Publication Data

US 2003/0234699 A1 Dec. 25, 2003

(30) Foreign Application Priority Data

Jun. 24, 2002 (JP) ..... 2002-183518
Dec. 2, 2002 (JP) ..... 2002-350087

(51) Int. Cl.[7] ..... H01P 1/10
(52) U.S. Cl. ..... 333/262; 333/101; 333/136
(58) Field of Search ..... 333/100, 101, 333/136, 124, 125, 262

(56) References Cited

U.S. PATENT DOCUMENTS

| | | | | |
|---|---|---|---|---|
| 4,023,125 A | | 5/1977 | Wolfe | 333/84 |
| 4,789,846 A | | 12/1988 | Matsunaga et al. | 333/104 |
| 6,166,436 A | * | 12/2000 | Maeda et al. | 257/723 |

FOREIGN PATENT DOCUMENTS

| | | |
|---|---|---|
| DE | 199 53 178 | 10/2000 |
| EP | 0 609 746 | 8/1994 |
| JP | 05055803 | 3/1993 |
| JP | 6-232601 | 8/1994 |
| JP | 10-41404 | 2/1998 |
| JP | 2000-294568 | 10/2000 |
| JP | 2000-332502 | 11/2000 |
| JP | 2000332502 | 11/2000 |

OTHER PUBLICATIONS

Abstract (03014110.5), Patent Abstracts of Japan, Katayama Tetsuya, Nov. 30, 2000.

* cited by examiner

*Primary Examiner*—Don Le
(74) *Attorney, Agent, or Firm*—Ostrolenk, Faber, Gerb & Soffen, LLP

(57) ABSTRACT

A high-frequency switch comprises: a substrate; a main line electrode provided between two terminals; a stub line electrode with one end thereof connected to the side edge of the main line electrode and the other end thereof grounded; and a ground electrode provided adjacent to the stub line electrode in the width direction thereof; wherein the substrate has a semiconductor activation layer which extends to below the stub line electrode and the ground electrode between at least one side edge of the stub line electrode and the ground electrode; and wherein a gate electrode which extends in the longitudinal direction of the stub line electrode is provided on the semiconductor activation layer between the stub line electrode and the ground electrode, thereby forming an FET structure, thus providing a high-frequency switch and electronic device therewith, capable of using high frequencies, having reduced insertion loss, and high signal cut-off capabilities.

16 Claims, 20 Drawing Sheets

HIGH-FREQUENCY SWITCH, AND ELECTRONIC DEVICE USING THE SAME

BACKGROUND OF THE INVENTION

1. Field of the Invention

The present invention relates to a high-frequency switch and an electronic device using the same, and particularly to a high-frequency switch used for switching millimeter bandwidth signals and an electronic device using the same.

2. Description of the Related Art

Generally, switches using PIN diodes are used for switching millimeter bandwidth signals and so forth. Switches using FETs may be used for relatively low frequencies, such as switches which use the lines themselves where high-frequency signals pass, as the drain and source of the FETs. Specific examples are disclosed in Japanese Unexamined Patent Application Publication No. 6-232601, Japanese Unexamined Patent Application Publication No. 10-41404, Japanese Unexamined Patent Application Publication No. 2000-294568, Japanese Unexamined Patent Application Publication No. 2000-332502, and so forth.

Japanese Unexamined Patent Application Publication No. 6-232601 (first conventional example) discloses a high-frequency switch which uses a part of the signal lines as an FET by dividing a signal line into multiple drain electrodes by multiple slits traversing the signal line in the width direction thereof, and also forming source electrodes and gate electrodes (lines) extending in the width direction of the signal line in the same manner as with the slits (e.g., FIG. 13 in the Publication). The drain electrodes are each connected by metal lines. Also, inductance devices having parallel resonance with the off capacitance of the FET at the signal frequency are connected between the drains and sources of the FETs.

In the first conventional example, the signal line itself is constantly in a DC conducting state, including the portions where the FET is formed. Upon the FET turning on, the impedance of the circuit connected between the signal line and ground is reduced to an almost short-circuit state. Consequently, a portion of the signal line is in a generally grounded state so the high-frequency signals are reflected, preventing conduction. Conversely, when the FET is off, the impedance at the frequency of the high-frequency signals of the circuit connected between the signal line and ground becomes infinite, due to the parallel resonance between the off capacitance of the FET and the inductance device. This means that nothing is connected to the signal line at the frequency of the high-frequency signals, so the high-frequency signals are conducted. Thus, switching operations are carried out.

Japanese Unexamined Patent Application Publication No. 10-41404 (second conventional example) discloses a high-frequency switch wherein, at a part of the signal line (functioning as a drain electrode), a ground electrode (functioning as a source electrode) is formed adjacent thereof in the longitudinal direction, and a gate electrode extending in the longitudinal direction of the signal line is formed in the gap therebetween (e.g., FIG. 6 in the Publication).

With the second conventional example, the part of the signal line acting as a drain acts simply as the signal line when the FET is off, so the signal line conducts the high-frequency signals. On the other hand, when the FET is off, the part of the signal line acting as the drain is connected to the ground electrode, so the part of the signal line is essentially grounded, so the high-frequency signals are reflected, and conduction is prevented.

Japanese Unexamined Patent Application Publication No. 2000-294568 (third conventional example) discloses a configuration with the same FET configurations as in the first conventional example (FIG. 8 in the Publication, no inductance device for parallel resonance), and with the drain, source, and gate of the FET extending in the line direction of the signal line with the same configuration (FIG. 1 in the Publication).

In the third conventional example as well, the same operations as with the second conventional example are performed, in that a part of the signal line essentially is grounded when the FET is on, thereby preventing conduction of high-frequency signals.

Japanese Unexamined Patent Application Publication No. 2000-332502 (fourth conventional example) discloses an arrangement wherein a ¼ wavelength stub is connected to the main line of the signal lines, and further wherein the tip of the stub is used as the drain electrode and the source electrode is grounded, thereby forming an FET (FIGS. 2 and 6 in the Publication). Turning the FET on and off operates the stub as a ¼ wavelength short stub and an open stub.

In the fourth conventional example as well, the stub serves as a ¼ wavelength open stub when the FET is off, and the same operation as with the second and third conventional examples is performed in that a part of the signal line essentially is grounded under the frequency of high-frequency signals, thereby preventing connection of high-frequency signals.

Now, with the first conventional example, there is the need to reduce the conduction resistance when the FET is on, and to that end, there is the need to increase the number of signal line divisions and increase the number of gate electrodes, so as to increase the total gate width of the FET. Increasing the total gate width necessitates a greater off capacitance of the FET, so there is the need to reduce the inductance value of the inductance device for parallel resonance, accordingly. However, there is a limit to how far the shape of the inductance device can be reduced with the same level of precision in inductance value. Further, the higher the signal frequency is, the smaller the inductance value needs to be, so there is the problem with this configuration that the higher the signal frequency is, the harder it is to use.

On the other hand, with the second conventional example, the above problem, wherein the higher the signal frequency is the harder the device is to use, does not occur since the resonance phenomenon is not used. However, with the first conventional example, the main line itself of the signal lines, where high-frequency signals flow when the FET is switched on, is the drain electrode of the FET. At least a part of the drain electrode is formed on a semiconductor activation layer, which means that part of the main line has been formed on a semiconductor activation layer. The high-frequency signals flow through the semiconductor activation layer as part of the line, but the semiconductor activation layer is a conductor with higher resistance than the drain electrode, meaning that the resistance of the main line is increased. Accordingly, with switches wherein the main line itself is the drain electrode for the FET as with the first conventional example, this arrangement is a factor in increasing insertion loss of the main line.

Also, the on resistance per increment length of the FET can be reduced by changing the cross-sectional structure of the FET, which is not necessarily easy. In the event that the on resistance per increment length cannot be changed, there is the need to increase the gate width of the FET in order to effect sufficient grounding of the main line when the FET is on. Increasing the gate width of the FET means extending the gate electrode in the longitudinal direction of the signal line, which in turn means that the drain electrode also becomes longer, resulting in an increased size of the switch in the longitudinal direction of the main line. The drain electrode is also the main line formed on the semiconductor activation layer where high-frequency signals are applied, and accordingly, the tendencies of increase in the above-described insertion loss of the main line are further accentuated.

Next, the third conventional example has been same basic configuration as with the first conventional example, and has the same problems.

Finally, with the fourth conventional example, the main line where the high-frequency signals flow is not the drain electrode, so there is no problem of increased insertion loss upon switching on. However, there is the need to lengthen the gate width of the FET to obtain grounding with sufficiently low resistance for the stub end. Lengthening the FET gate width increases the capacitance between the drain and source when the FET is off. This means that a great capacitance exists between the tip of the open stub and the ground with the FET is off. In the event that a great capacitance exists at the tip of the open stub, the resonance frequency of the open stub decreases, so the resonance frequency may be different from that when a short stub. Having different resonance frequencies for an open stub and short stub means that the switch cannot function normally, which is a great problem.

SUMMARY OF THE INVENTION

The present invention has been made to solve the above-described problems, and accordingly, provides a high-frequency switch and an electronic device using the same which can be used up to high frequencies, with little insertion loss when switching on, and with high signal cut-off properties when switching off.

To achieve these features, a high-frequency switch according to the present invention comprises: a substrate; a main line electrode provided between two terminals; a stub line electrode with one end thereof connected to the side edge of the main line electrode and the other end thereof grounded; and a ground electrode provided adjacent to the stub line electrode in the width direction thereof; wherein the substrate has a semiconductor activation layer which extends to below the stub line electrode and the ground electrode, between at least one side edge of the stub line electrode and the ground electrode; and wherein a gate electrode which extends in the longitudinal direction of the stub line electrode is provided on the semiconductor activation layer between the stub line electrode and the ground electrode, thereby forming an FET structure.

A semiconductor activation layer which extends to below the stub line electrode and the ground electrode may be provided to a substrate portion between the side edge of the stub line electrode from one end thereof to the other end, and the ground electrode, with a gate electrode which extends in the longitudinal direction of the stub line electrode being provided on the semiconductor activation layer between the stub line electrode and the ground electrode, thereby forming an FET structure.

The FET structure may be formed on both side edges of the stub line electrode. The stub line electrode with the FET structure may form a coplanar waveguide along with the ground electrode, and the stub line electrode with the FET structure may be formed so as to have electrical length generally 90° to that of the applied high-frequency signals.

One end of the stub line electrode with a plurality of the FET structures formed may be connected to the side edge of the main line electrode, or one end of a stub line electrode with the two FET structures formed may be connected from both width-wise sides of the main line electrode in an opposing manner.

One end of a stub line electrode with a plurality of the FET structures formed may be connected to the side edge of the main line electrode with a predetermined gap therebetween with regard to the longitudinal direction, and one end of a stub line electrode with a plurality of the FET structures formed may be connected to the side edge of the main line electrode with a gap therebetween, of electrical length generally 90° with regard to that of the high-frequency signals applied in the longitudinal direction.

One end of each of the plurality of high-frequency switches may be connected to each other via a main line electrode with electrical length of generally 90° as to high-frequency signals to the contact point of the stub line electrode where the FET structure closest to each is formed.

Also, the gate electrode may be extracted from one end of the stub line electrode in a direction away from the main line electrode; or from the other end of the stub line electrode in a direction across the main line electrode.

An electronic device may use the above-described high-frequency switch.

With the high-frequency switch according to the present invention, the switch acts to cut off the high-frequency signals flowing through the main line electrode by grounding a portion of the main line electrode by turning this FET on, and conducting the high-frequency signals flowing through the main line electrode by turning this FET off. The main line electrode exists only at a part of the FET, so insertion loss when switching on can be reduced. Also, a grounding state with no frequency properties can be realized, so the high-frequency signals can be cut off in a stable manner when switching off. Consequently, high isolation properties can be obtained.

Further, with the electronic device according to the present invention, reduction in power consumption and in malfunctions can be realized by using the high-frequency switch according to the present invention.

Other features and advantages of the present invention will become apparent from the following description of embodiments of the invention which refers to the accompanying drawings.

DESCRIPTION OF EMBODIMENTS OF THE INVENTION

Figure 1:
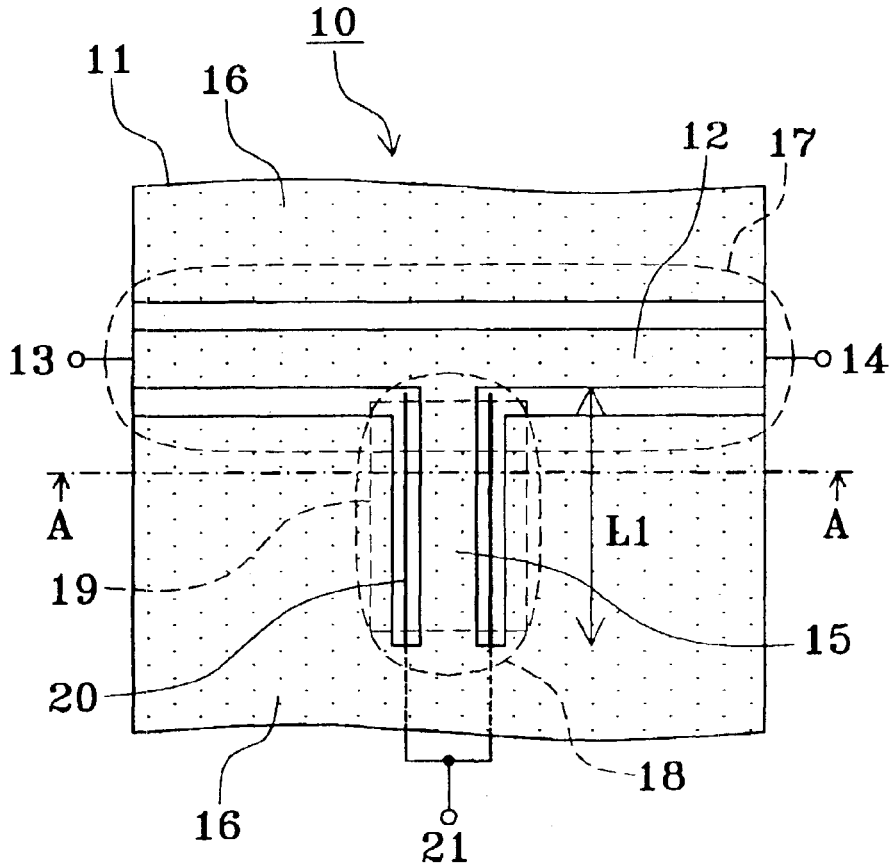
FIG. 1 is a plan view illustrating an embodiment of a high-frequency switch according to the present invention.
Figure 2:
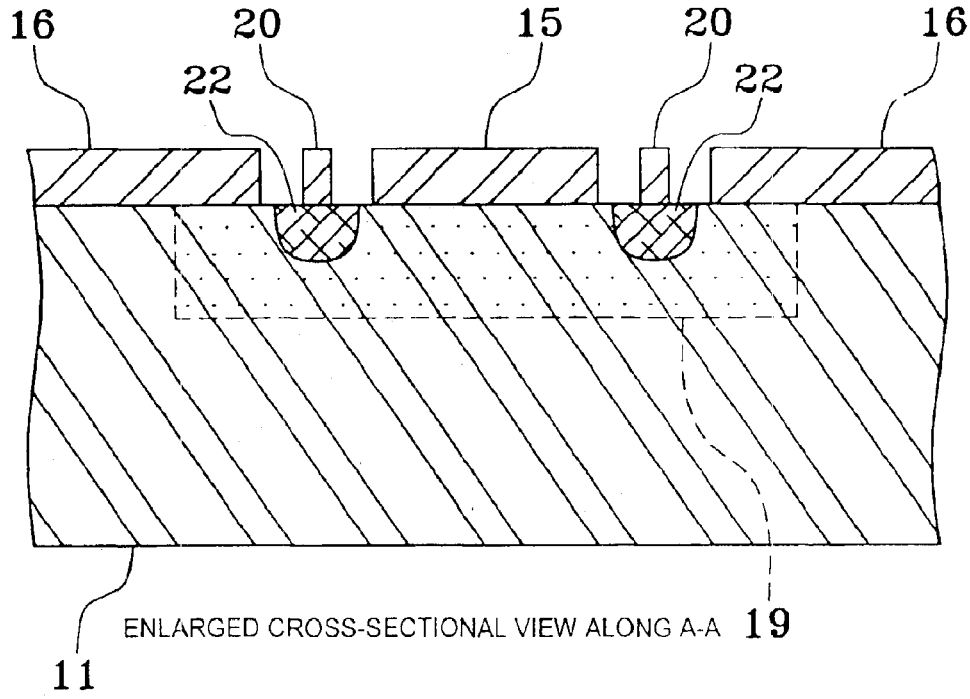
FIG. 2 is an enlarged view of a cross-section along line A—A of the high-frequency switch shown in FIG. 1.

FIG. 1 is a plan view illustrating an embodiment of a high-frequency switch according to the present invention, and FIG. 2 is an enlarged view of a cross-section along line A—A of the high-frequency switch shown in FIG. 1.

In FIG. 1, a high-frequency switch 10 has a main line 17 and stub 18 formed of a coplanar wave guide formed on a semiconductor substrate 11. The main line 17 is formed of a main line electrode 12 and ground electrodes 16 formed on both sides thereof in the width direction, with one end and the other end being connected to terminals 13 and 14, respectively. The stub 18 is formed of a stub line electrode 15 and ground electrodes 16 formed on both sides thereof in the width direction, with one end connected to the main line 17, and the other end connected to the ground electrode 16 so as to be grounded. Or, in more precise terms, one end of the stub line electrode 15 of the stub 18 is connected to the side edge of the main line electrode 12 of the main line 17, and the other end thereof is connected to the ground electrode 16. Further, the length of the stub line electrode 15 of the stub 18 is set so as to have an electrical length 90° as to the high-frequency signals intended to flow through the stub 18.

A semiconductor activation layer 19 is formed on the semiconductor substrate 11 between the stub line electrode 15 and the ground electrode 16 from one end of the stub 18 to the other end. The semiconductor activation layer 19 extends to below the stub line electrode 15 and the ground electrode 16. Note that the portions of the semiconductor substrate 11 other than the semiconductor activation layer 19 are essentially insulators.

Gate electrodes 20 are formed on the semiconductor activation layer 19 extending in the longitudinal direction of the stub line electrode 15, between the stub line electrode 15 of the stub 18 and the ground electrode 16. The gate electrodes 20 are connected from the other end side of the stub line electrode 15 to a gate voltage input terminal 21. Though a portion of the line from the gate electrodes 20 to the gate voltage input terminal 21 overlaps the ground electrode 16, in this region both are insulated by an insulating layer or the like. The gate electrodes 20 are represented by solid and dashed lines in FIG. 1, but in reality are electrodes having a certain width as shown in FIG. 2.

Also, though the main line electrode 12 is shown in FIGS. 1 and 2 as formed directly on the semiconductor substrate 11, the non-activated portion of the semiconductor substrate 11 is not necessarily a sufficient insulator, so an insulating film is preferably provided between the main line electrode 12 and the semiconductor substrate 11, in order to prevent unnecessary leaking.

As shown in the enlarged cross-section along line A—A shown in FIG. 2, electrodes are formed on both sides of the gate electrodes 20 in the region where the semiconductor activation layer 19 is formed, so it can be understood that this is overall an FET structure. In this case, the stub line electrode 15 may be the drain, and the ground electrodes 16 may be the source, or vice versa. The interfaces between the gate electrodes 20 and the semiconductor activation layer 19 provide a Schottky junction and the connections between the stub line electrode 15 and ground electrodes 16 and the semiconductor activation layer 19 are ohmic connections. Further, depletion layers 22 are formed in the semiconductor activation layer 19 below the gate electrodes 20.

With the high-frequency switch 10 thus configured, setting the DC potential of the drain and source (the stub line electrode 15 and ground electrodes 16) to 0 V and further setting the DC potential of the gate electrodes 20 to 0 V, for example, results in the gate not being biased with respect to the drain and source and the depletion layers 22 are reduced, so the drain and source are almost short-circuited along the entire longitudinal direction of the stub line electrode 15 via the semiconductor activation layer 19.

Figure 3:
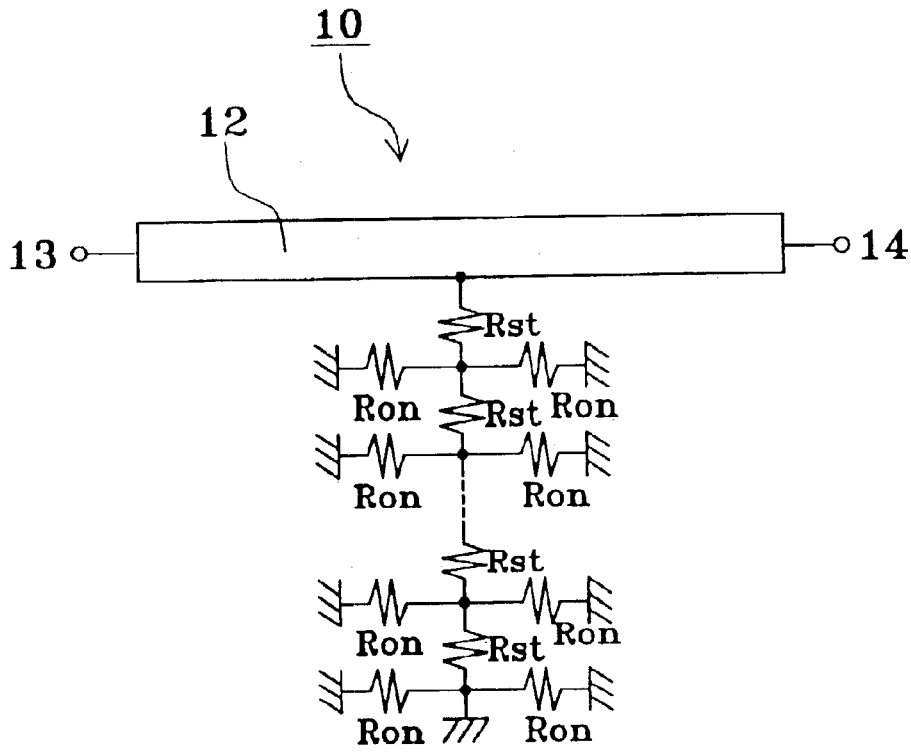
FIG. 3 is an equivalent circuit diagram of the high-frequency switch shown in FIG. 1 in an off state.
Figure 4:
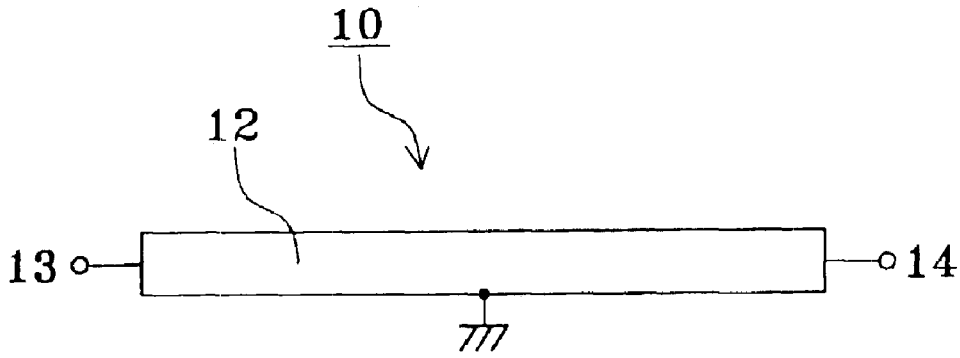
FIG. 4 is a simplified equivalent circuit diagram of the high-frequency switch shown in FIG. 1 in an off state.

FIG. 3 shows an equivalent circuit of the high-frequency switch 10 in this state. In FIG. 3, Rst is the resistor component per increment length of the stub line electrode 15, and Ron is the on resistance of the FET portion per increment length of the stub line electrode 15. Rst and Ron are small values, and further since there are a great number of Rst and Ron components both serially and parallel, the high-frequency switch 10 equivalently comprises the main line electrode 12 being essentially short-circuited to the ground electrode 16 at the base portion of the stub line electrode 15 (the portion of the stub line electrode 15 connected with the main line electrode 12), as shown in FIG. 4. That is, the main line 17 is grounded partway along.

In this state, the high-frequency signals flowing through the high-frequency switch 10 are almost completely reflected at this contact point and are not propagated from one end to the other end between the terminals 13 and 14. That is to say, the high-frequency switch 10 is in an off state.

On the other hand, setting the DC potential of the drain and source (the stub line electrode 15 and ground electrodes 16) to 0 V and further setting the DC potential of the gate electrodes 20 to −3 V for example, results in the gate being inversely biased with respect to the drain and source, and the depletion layers 22 are increased, so the semiconductor activation layer 19 is isolated so as to cut off the drain and source.

Figure 5:
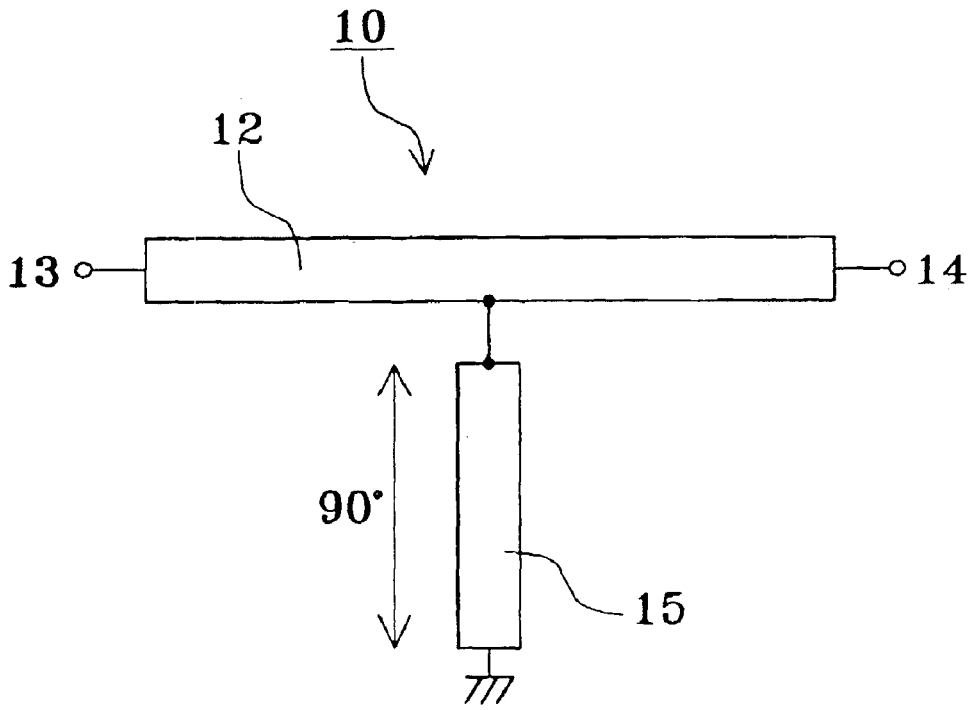
FIG. 5 is an equivalent circuit diagram of the high-frequency switch shown in FIG. 1 in an on state.
Figure 6:
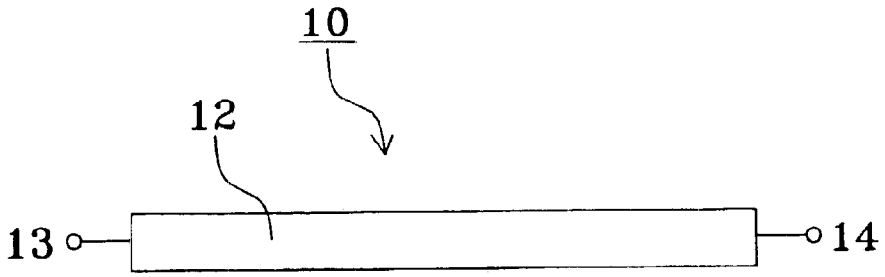
FIG. 6 is a simplified equivalent circuit diagram of the high-frequency switch shown in FIG. 1 in an on state.

FIG. 5 shows an equivalent circuit of the high-frequency switch 10 in this state. The FET portion is cut off, so the high-frequency switch 10 consists simply of the stub line electrode 15 being connected to the main line electrode 12. The stub line electrode 15 is a stub short-circuited at the other end which has an electrical length of 90° as to the high-frequency signals flowing through, so the stub has ideally infinite impedance as viewed from the contact point with the main line electrode 12. Accordingly, the high-frequency switch 10 equivalently comprises the main line electrode 12 alone as shown in FIG. 6, with respect to signals having the intended frequency of use.

In this state, the high-frequency signals flowing through the high-frequency switch 10 can be freely propagated between the terminals 13 and 14. That is to say, the high-frequency switch 10 is in an on state.

Thus, with the high-frequency switch 10, switching actions can be performed between the terminal 13 and the terminal 14 by the DC voltage applied to the gate electrodes 20.

Figure 7:
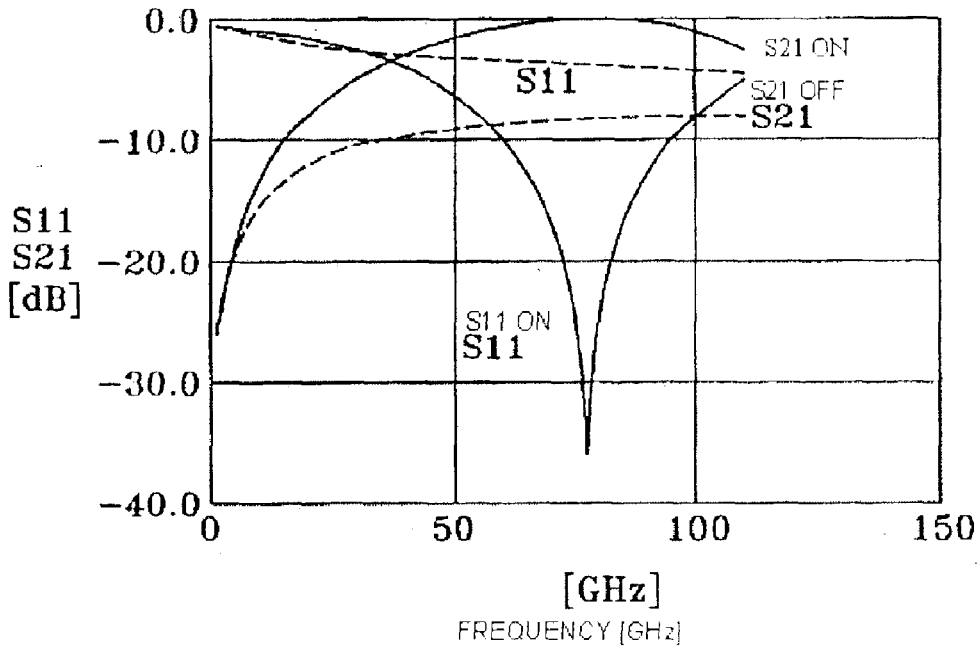
FIG. 7 is a properties diagram illustrating the switching properties of the high-frequency switch shown in FIG. 1.

Now, FIG. 7 illustrates the passing properties S21 and reflection properties S11 for the on state and off state of the high-frequency switch 10. In FIG. 7, the solid lines indicate the properties of the high-frequency switch 10 when on, and the dotted lines when off.

As can be understood from FIG. 7, in the event that the high-frequency switch 10 is on, the passing properties S21 become extremely small at 76 GHz which is the frequency of the high-frequency signals, and the reflection properties S11 are approximately −35 dB, thereby obtaining sufficient signal passing properties. On the other hand, in the event that the high-frequency switch 10 is off, the passing properties S21 are approximately −8 dB at 76 GHz, and the refection properties S11 are approximately −4 dB, thereby yielding generally-satisfactory signal cut-off properties.

With the high-frequency switch 10 configured thus, only the stub line electrode 15 is used as a part of the FET, and the main line electrode 12 where the high-frequency signals primarily flow is not part of the FET. Accordingly, the problem wherein insertion loss of the main line increases due to the high-frequency signals flowing through a conductor with high resistance formed of the semiconductor activation layer when switched on, as with the first through third conventional examples, does not occur.

Also, the stub line electrode 15 extends in a direction orthogonal to the main line electrode 12, so there is no problem of increased size of the switch in the longitudinal direction of the main line, as with the second conventional example.

Further, the stub line electrode 15 functions as a short stub when the FET is off but does not function as a short stub when the FET is on. That is to say, the grounding of a part of the main line electrode 12 when the FET is on is not due to resonance. Accordingly, all that needs to be taken into consideration is that the length of the stub line electrode 15 should act as a short stub having electrical length of 90° when the FET is off, and there is no need to take into consideration the state when the FET is on. Accordingly, the problems of the fourth conventional example do not occur.

Also, not using resonance for grounding of a portion of the main line electrode 12 means that there are no frequency properties wherein a grounded state is effected only under a certain signal frequency. Accordingly, in the event that the FET is on and the high-frequency switch 10 is off, the off state is maintained over a wide range of frequencies. That is, high isolation properties can be obtained.

Note that isolation properties here mean S21 when the switch is off, and the greater the number of decibels is (i.e., the smaller the absolute value), the better the isolation properties are viewed to be.

With the fourth conventional example, the operation is limited to a certain frequency range at which it operates as a high-frequency switch, as can be understood from the fact that a part of the main line electrode is grounded by resonance when turning off the switch, so the high-frequency switch 10 according to the present invention has excellent performance from this standpoint, as well. As for when the high-frequency switch is on, both the present invention and the fourth conventional example use the resonance of the stub, so there is no different in their capabilities.

Now, with the high-frequency switch 10 shown in FIG. 1, there is no need for an FET to be formed along the entire length from one end of the stub line electrode 15 to the other end in order to essentially ground the main line electrode 12 at the position where the stub line electrode 15 is connected when the FET is on. An arrangement wherein an FET is formed at least at one end of the stub line electrode 15, i.e., the end where the main line electrode 12 is connected, over a certain length, with a sufficiently low resistance value for grounding when the FET is on, is sufficient.

Figure 8:
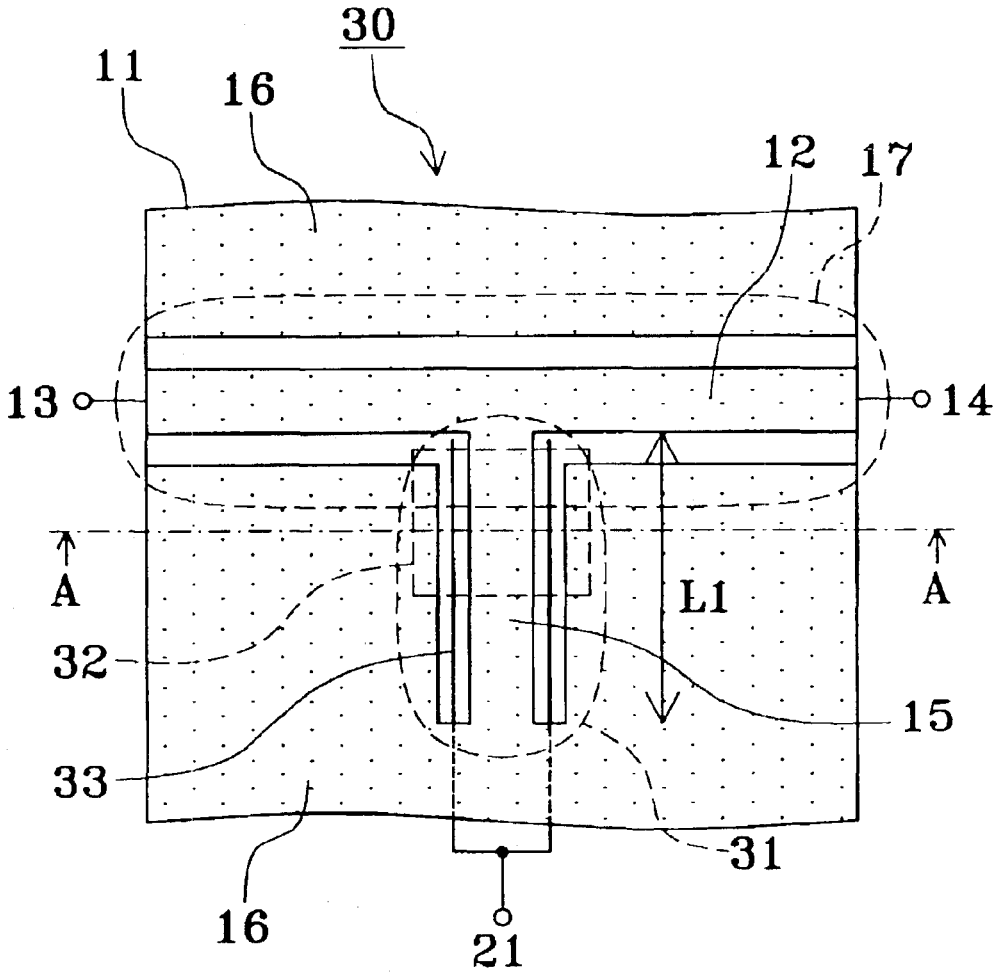
FIG. 8 is a plan view illustrating another embodiment of the high-frequency switch according to the present invention.

Accordingly, FIG. 8 is a plan view illustrating another embodiment of the high-frequency switch according to the present invention. In FIG. 8, the parts which are the same as or equivalent to those in FIG. 1 are denoted with the same reference numerals, and description thereof will be omitted. The cross-sectional view of the FET portion is the same as that in FIG. 2, and accordingly will be omitted.

The high-frequency switch 30 shown in FIG. 8 has a stub 31 instead of the stub 18 in the high-frequency switch 10. With the stub 31, the semiconductor activation layer 32 is formed between the stub line electrode 15 and the ground electrode 16 over approximately half the length of the stub 31 at one end. Gate electrodes 33 extending in the longitudinal direction of the stub line electrode 15 are formed on the semiconductor activation layer 32 between the stub line electrode 15 of the stub 31 and the ground electrode 16, so as to traverse the semiconductor activation layer 32. The gate electrodes 33 are connected to the gate voltage input terminal 21. Note that in this embodiment the gate electrodes 33 are formed not only on the semiconductor activation layer 32 but also on the portions between the stub line electrode 15 and the ground electrode 16 which are not the semiconductor activation layer. However, portions formed other than on the semiconductor activation layer 32 do not act as an FET but rather simply as a signal line, and accordingly will not be viewed as gate electrodes.

Figure 9:
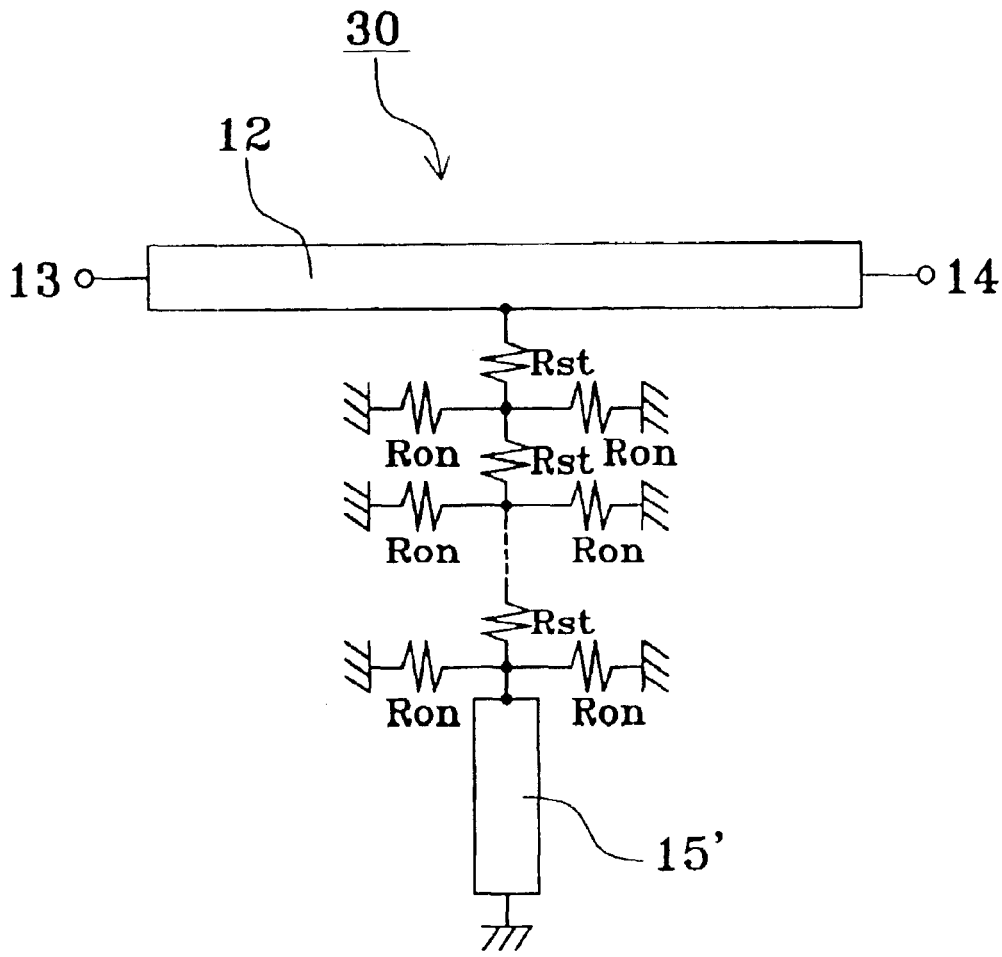
FIG. 9 is an equivalent circuit diagram of the high-frequency switch shown in FIG. 8 in an off state.

With the high-frequency switch 30 formed thus, the portion formed with an FET structure acts in the same way as with the high-frequency switch 10. An equivalent circuit of the high-frequency switch 30 with the FET on is shown in FIG. 9. In FIG. 9, the parts which are the same as or equivalent to those in FIG. 3 are denoted with the same reference numerals.

In FIG. 9, the portion of the stub line electrode 15 that is not a part of the FET remains as the line 15', but the one end connected to the main line electrode 12 is connected to the ground electrode 16 via a great number of Rst and Ron components as in the case of the high-frequency switch 10. Accordingly, the high-frequency switch 30 is an arrangement wherein equivalently, the main line electrode 12 is essentially grounded at the base portion of the stub line electrode 15, as with the high-frequency switch 10. That is to say, the main line 17 is grounded partway along.

In this state, the high-frequency signals flowing through the high-frequency switch 30 are almost completely reflected at this contact point and are not propagated from one end to the other end. That is to say, the high-frequency switch 30 between the terminals 13 and 14 is in an off state.

On the other hand, with the FET off, the FET portion is cut off, so the high-frequency switch 30 consists simply of the stub line electrode 15 being connected to the main line electrode 12. The stub line electrode 15 is a stub short-circuited at the other end which has an electrical length of 90° as to the high-frequency signals flowing through, so the high-frequency switch 30 equivalently comprises the main line electrode 12 alone regarding signal frequencies.

In this state, the high-frequency signals flowing through the high-frequency switch 30 can be freely propagated. That is to say, that high-frequency switch 30 between the terminals 13 and 14 is in an on state.

The length of the gate electrode (gate width) is sufficient as long as there is a length capable of realizing a sufficient short-circuit state between the ground electrode 16 and one side of the stub line electrode 15 when the FET is on. Accordingly, the gate length is not restricted to half the length of the stub line electrode as with the high-frequency switch 30, and may be shorter or longer than half.

When the FET is off, the off capacitance is distributed over the drain and source. Accordingly, the distributed capacitance between the stub line electrode 15 and the ground electrode 16 differs between the portions where the semiconductor activation layer 32 exists and the portions where the semiconductor activation layer 32 does not exist. Also, in strict terms, the distributed inductance component of the stub line electrode 15 also differs depending on whether situated on the semiconductor activation layer or not. Accordingly, the impedance property may differ according to the location on the stub 31. Hence, there is the need to decide the length and width of the stub 31 taking into consideration the partial changes of the impedance property of the stub 31 as described above.

In reality, adjusting the electrical length may very well be carried out by changing not only the entire length of the stub line electrode, but also changing the width of the stub line electrode between portions forming the FET portion and the other portions, and changing the spacing with respect to the ground electrode.

Now, with the high-frequency switch 30, the gate width, which is the length of the gate electrode, is shorter than that in the high-frequency switch 10. Accordingly, the off capacitance formed between the drain and source of the FET portion is smaller. This off capacitance partially determines the time constant for deciding the switching speed of the high-frequency switches 10 and 30. That is to say, the smaller the off capacitance is, the smaller the time constant is, and the faster the switching operations are. Accordingly, the high-frequency switch 30 has the advantage of being capable of handling higher-speed switching actions in comparison with the high-frequency switch 10.

It is normal for the gate electrode to be formed in a generally straight line, and it is not always easy to form the gate electrodes in a bent shape. Accordingly, with the high-frequency switch 10, the stub line electrode 15 of the stub 18 is formed in a straight line. This may lead to difficulties in reducing the size of the high-frequency switch.

Figure 10:
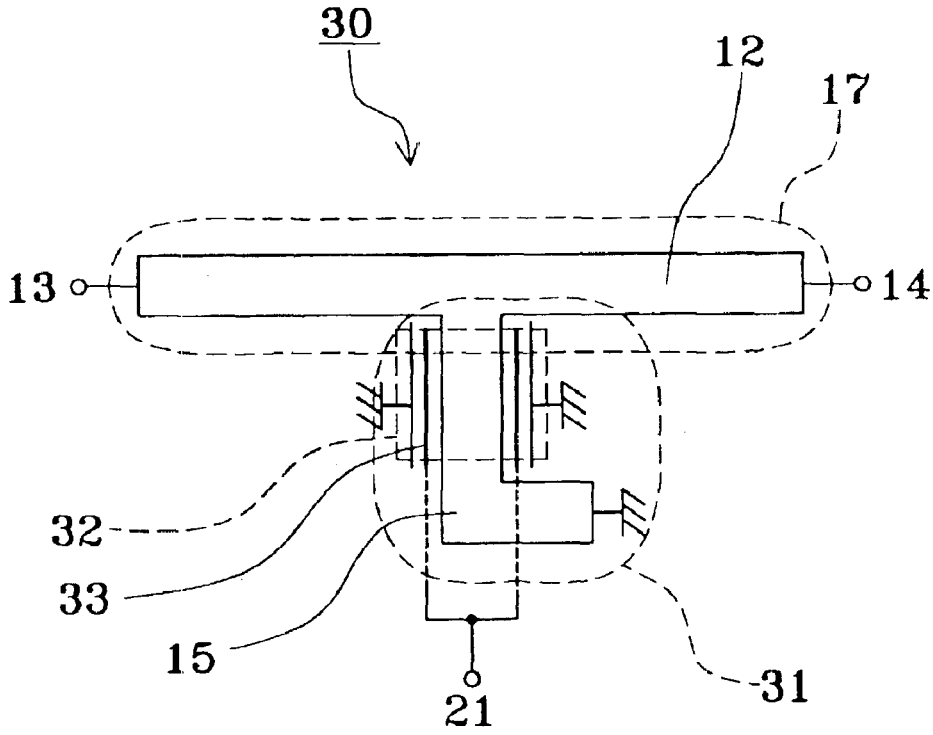
FIG. 10 is a plan view illustrating a variation of the high-frequency switch shown in FIG. 8.

On the other hand, as with the high-frequency switch 30, the gate electrodes 33 only need to be formed along one end of the stub line electrode 15. Accordingly, as illustrated in the schematic diagram of a modified embodiment shown in FIG. 10, the other end side of the stub line electrode 15 where the gate electrodes 33 are not formed can be bent. This can reduce the size of the high-frequency switch.

In this way, the high-frequency switch 30 is capable of faster switching operations than the high-frequency switch 10, and also is advantageous in that the size can be reduced since the stub can be bent.

Note that while FET structures are formed on both sides of the stub line electrodes with the high-frequency switch 10 and the high-frequency switch 30, formation on only one side is permissible. In this case, the resistance value when the FET turns on increases somewhat, but otherwise, the same advantages as the above-described embodiments can be had.

Also, note that in the high-frequency switch 10 and high-frequency switch 30, the main line and stub are taken as symmetrically shaped coplanar waveguides, and with the stub, the ground electrodes for the symmetrical coplanar waveguide were used as the source electrode for the FET. However, the main line and stub are not restricted to symmetrical coplanar waveguides, and may be asymmetrical coplanar waveguides with a ground electrode on only one side, for example. Or, the main line and stub may be another type of transmission line not having ground electrodes following the line electrode, such as a micro-strip line or the like. However, there is the need to provide a separate ground electrode adjacent to the stub line electrode in such cases. Also, at the same time, the stub impedance properties change from those of an ideal micro-strip line arrangement due to the ground electrode formed adjacent thereto, so this must be taken into consideration for deciding the length of the stub line electrode. Otherwise, the high-frequency switch can obtain approximately the same advantages as the above embodiments.

The following is a description of other embodiments of a high-frequency switch using a stub with the above-described FET structure. While the stub structure according to the high-frequency switch 30 is used in the following embodiments, it is needless to say that the stub structure of the high-frequency switch 10 may be used instead.

Figure 11:
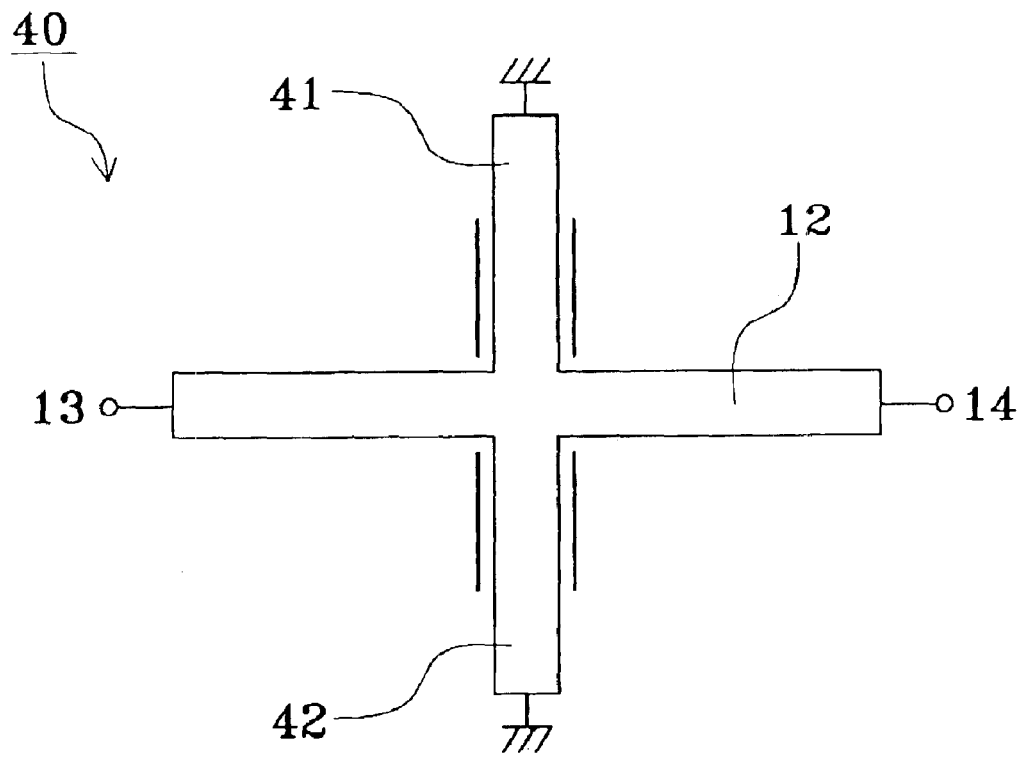
FIG. 11 is a plan view illustrating yet another embodiment of the high-frequency switch according to the present invention.

First, FIG. 11 shows a schematic diagram of another embodiment of the high-frequency switch according to the present invention. FIG. 11 is a simplified diagram to show only certain features, and the parts which are the same as or equivalent to those in FIG. 1 are denoted with the same reference numerals and description thereof will be omitted.

With the high-frequency switch 40 shown in FIG. 11, reference numerals 41 and 42 denote the stub line electrodes of the stub where the FET structure is formed. The lines on either side thereof represent gate lines. Description of the ground electrodes and gate voltage input terminal will be omitted.

As shown in FIG. 11, with the high-frequency switch 40, the two stub line electrodes 41 and 42 face one another across the side edges of the main line 12 in the width direction thereof. With the high-frequency switch 40 configured thus, the stub line electrodes 41 and 42 each function the same as the stub 31 in the high-frequency switch 30.

Accordingly, turning the FETs of the two stubs on and off, corresponding to turning the high-frequency switch 40 off and on, respectively, can place the main line electrode 12 in a state grounded partway along when the high-frequency switch is switched off. Moreover, while only one side edge of the main line electrode 12 was grounded at a particular position in the high-frequency switch 30, both side edges of the main line electrode 12 are grounded at a particular position in the high-frequency switch 40. This means that this point is grounded with half the resistance value as compared with the case of the high-frequency switch 30, so the cut-off state of the high-frequency switch 40 when off can be made more complete. That is, the isolation properties can be improved even further.

Also, from a different perspective, if the same ground resistance as in the high-frequency switch 30 is sufficient, the length of the stub gate electrodes (the gate width) can be made even shorter. A shorter gate width means that the switching operations can be made even faster, as described above. Also, the portion which must be formed in a straight line to provide the gate electrodes of the stub line electrodes 41 and 42 is reduced in length, so the freedom in design of the shape of the stub increases, meaning that the high-frequency switch can be reduced in size even further.

Thus, with the high-frequency switch 40, the cut-off capabilities of the high-frequency signals in the off state can be further improved, or the switching operations can be made faster or the high-frequency switch can be reduced in size.

Figure 12:
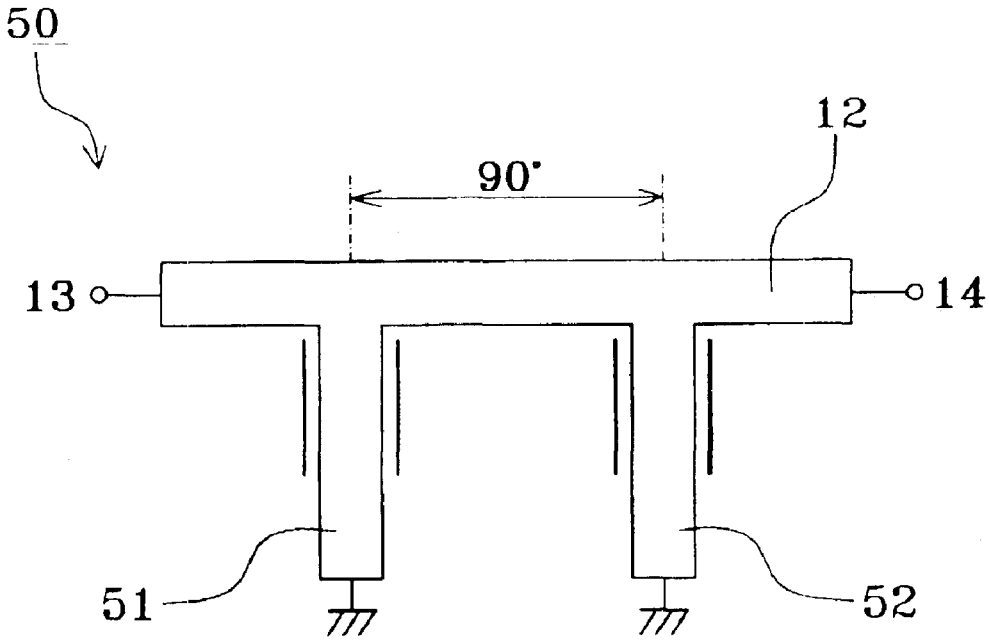
FIG. 12 is a plan view illustrating yet another embodiment of the high-frequency switch according to the present invention.

FIG. 12 shows a schematic diagram of yet another embodiment of the high-frequency switch according to the present invention. FIG. 12 is a simplified diagram to show only certain features, and the parts which are the same with or equivalent to those in FIG. 1 are denoted with the same reference numerals and description thereof will be omitted.

In the high-frequency switch 50 shown in FIG. 12, reference numerals 51 and 52 denote the stub line electrodes of the stub where the FET structures are formed. The lines on either side thereof represent gate lines. Description of the ground electrodes and gate voltage input terminal will be omitted.

As shown in FIG. 12, with the high-frequency switch 50, the two stub line electrodes 51 and 52 are provided on one side of the main line electrode 12, at positions distanced by 90° in electrical length in the longitudinal direction of the main line electrode 12. With the high-frequency switch 50 configured thus, the stub line electrodes 51 and 52 each function the same as the stub 31 in the high-frequency switch 30.

Accordingly, simultaneously turning on and off the FETs of the two stubs corresponding to turning the high-frequency switch 50 off and on enables the main line electrode 12 to be grounded at two positions partway along at the time of switching the high-frequency switch off. Thus, grounding at two positions enables the high-frequency switch 50 to be cut off by reflecting the high-frequency signals in a more complete manner even in cases wherein the length of the gate electrodes of the stubs is too short so one ground is not necessarily sufficient. Moreover, the two stubs are connected at positions distanced by 90° in electrical length in the longitudinal direction of the main line electrode 12, so the impedance of the one stub as viewed from the other stub is infinite, and essentially invisible, so there are no adverse effects of reflecting signals from one stub on the properties, and particularly the ground state, of the other stub.

Figure 13:
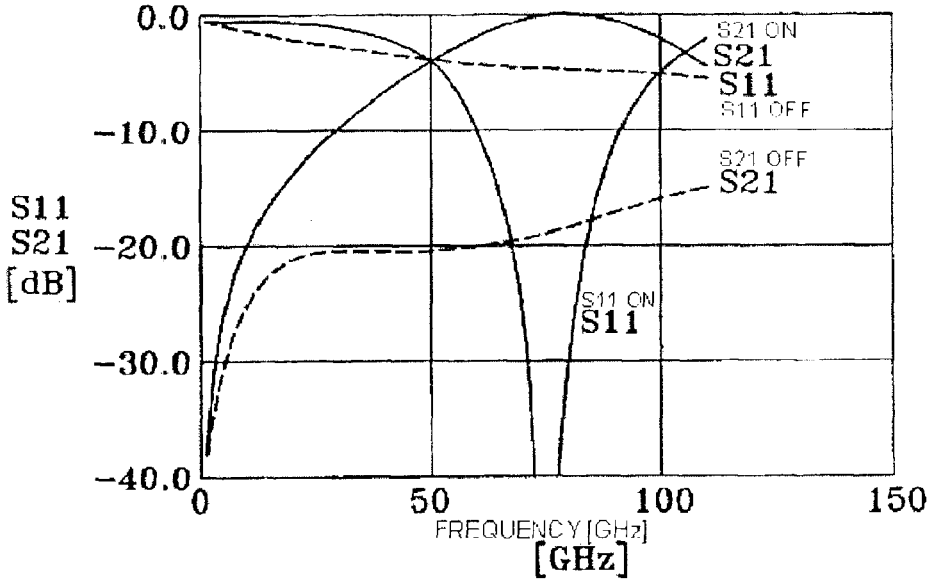
FIG. 13 is a properties diagram illustrating the switching properties of the high-frequency switch shown in FIG. 12.

Now, FIG. 13 illustrates the passing properties S21 and reflection properties S11 for the on state and off state of the high-frequency switch 50. In FIG. 13, the solid lines indicate the properties of the high-frequency switch 10 when on, and the dotted lines when off.

As can be understood from FIG. 13, in the event that the high-frequency switch 50 is on, the loss of the passing properties S21 become extremely small around 0 dB at 76 GHz which is the frequency of the high-frequency signals, and the reflection properties S11 are −40 dB or less, thereby obtaining sufficient signal passing properties. On the other hand, in the event that the high-frequency switch 50 is off, the passing properties S21 are approximately −19 dB at 76 GHz, and the reflection properties S11 are −4 dB, so the amount of passage is even less than that of the high-frequency switch 10, thereby yielding sufficient signal cut-off properties.

Thus, with the high-frequency switch 50, cut-off properties when switched off can be further improved.

Also, while the high-frequency switch 50 has two stubs each with FET structures, the number of stubs may be three or more, as long as the stubs are connected at positions distanced by 90° in electrical length from each other in the longitudinal direction of the main line electrode 12.

Also, while the high-frequency switch 50 has the stubs connected only on one side of the main line electrode 12, the stubs may also be provided on both side edges thereof.

Now, though the high-frequency switch 50 has two stubs provided and connected at positions distanced by 90° in electrical length in the longitudinal direction of the main line electrode 12, in order to avoid influencing each other, an arrangement may be conceived wherein the stubs are provided closer to each other.

Figure 14:
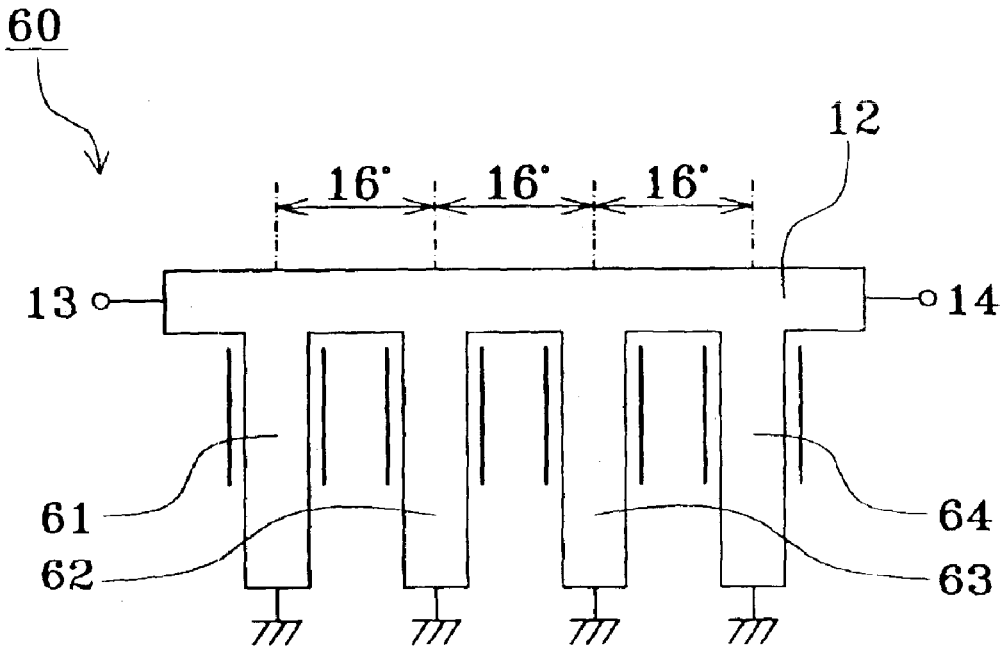
FIG. 14 is a plan view illustrating yet another embodiment of the high-frequency switch according to the present invention.

Now, FIG. 14 shows a schematic diagram of yet another embodiment of the high-frequency switch according to the present invention. FIG. 14 is a simplified diagram to show only certain features, and the parts which are the same as or equivalent to those in FIG. 1 are denoted with the same reference numerals and description thereof will be omitted.

With the high-frequency switch 60 shown in FIG. 14, reference numerals 61, 62, 63, and 64 denote the stub line electrodes of the stubs where the FET structures are formed. The lines on either side thereof represent gate lines. Description of the ground electrodes and gate voltage input terminal will be omitted.

As shown in FIG. 14, with the high-frequency switch 60, the four stub line electrodes 61, 62, 63, and 64 are provided and connected at one side edge of the main line electrode 12, at positions distanced by 16° in electrical length from each other in the longitudinal direction of the main line electrode 12. The length of each stub line electrode is set to 110° in electrical length at the signal frequency. Also, the impedance of the main line is set to 75 Ω, and the impedance of the stubs is set to 35 Ω. With the high-frequency switch 60 configured thus, the stub line electrodes 61, 62, 63, and 64 each function the same as the stub 31 in the high-frequency switch 30.

With the high-frequency switch 60 as well, simultaneously turning on and off the FETs of the four stubs corresponding to turning the high-frequency switch 60 off and on enables the main line electrode 12 to be grounded at four positions partway along at the time of switching the high-frequency switch off. Thus, grounding at four positions enables the grounding state to be better than with two, whereby the high-frequency switch 60 is cut off by reflecting the high-frequency signals in a more complete manner.

Now, with the high-frequency switch 60, the stubs are provided and connected at positions distanced by 16° in electrical length in the longitudinal direction of the main line electrode 12. Accordingly, this embodiment does not have the advantage of the stubs being mutually invisible so as to do away with mutual adverse effects. However, there is the advantage in that the frequency bandwidth is wider in the reflection properties when the FET is off (i.e., when the switch is on), so conformity can be obtained with other frequencies as well. Also, the interval of the stubs is short, so the size of the high-frequency switch in the longitudinal direction can be reduced. Further, the length of the main line is shorter, so the insertion loss when turning the switch on can be reduced.

Also, the number of stubs is great, so there is the advantage that the electric power consumption at each stub increases and the insertion loss at the time of switching off increases, due to the reflection of high-frequency signals between the stubs and the ground resistance at the stubs when the FETs are on.

Figure 15:
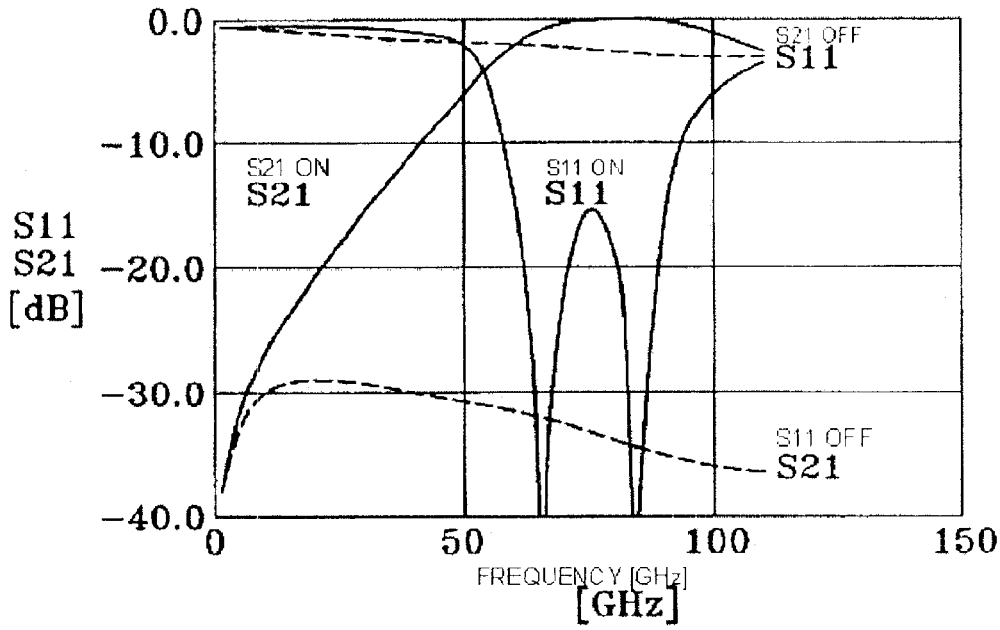
FIG. 15 is a properties diagram illustrating the switching properties of the high-frequency switch shown in FIG. 14.

Now, FIG. 15 illustrates the passing properties S21 and reflection properties S11 for the on state and off state of the high-frequency switch 60. In FIG. 15, the solid lines indicate the properties of the high-frequency switch 60 when on, and the dotted lines when off.

As can be understood from FIG. 15, in the event that the high-frequency switch 60 is on, the loss of the passing properties S21 become extremely small around 0 dB at 76 GHz which is the frequency of the high-frequency signals, and the reflection properties S11 are −15 dB or less over a broad bandwidth, thereby obtaining sufficient signal passing properties. On the other hand, in the event that the high-frequency switch 60 is off, the passing properties S21 are approximately −33 dB at 76 GHz, and the reflection properties S11 are approximately −3 dB, so the amount passing is markedly less than with the high-frequency switch 10, thereby yielding sufficient signal cut-off properties.

The reason that two troughs exists for the reflection properties S11 at the time of switching on is due to the increased number of stubs. Properties such as the frequency of the troughs, the spacing therebetween, the amount of reflection between troughs, and so forth, can be set by suitably adjusting the stub spacing, the length and impedance of the stubs, and the impedance of the main line. This is why the stub length of the high-frequency switch 60 is set to 110° in electrical length.

Thus, with the high-frequency switch 60, the cut-off properties when off can be further improved.

Note that while the spacing between the stubs is 16° with the high-frequency switch 60, this is only one example, and may be freely set as necessary. Also, the number of stubs may be freely arranged, as long as two or more are provided.

Figure 16:
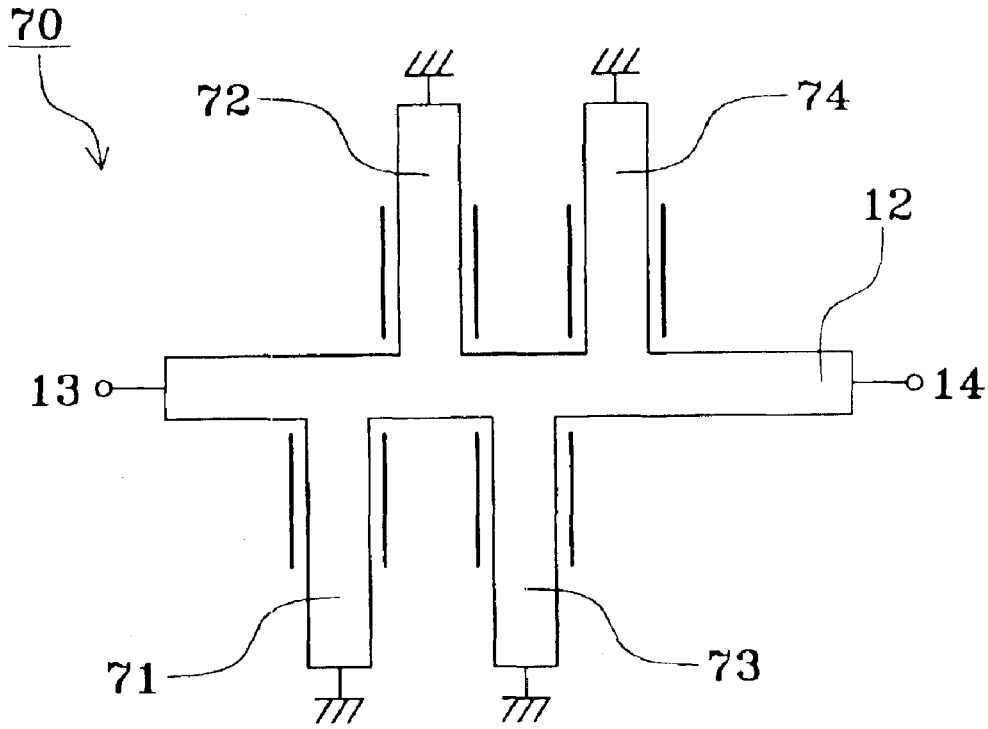
FIG. 16 is a plan view illustrating yet another embodiment of the high-frequency switch according to the present invention.

Also, while the high-frequency switch 60 has the stubs connected only on one side of the main line electrode 12, the stubs may be connected on both sides thereof, as in the high-frequency switch 70 shown in FIG. 16, for example. Particularly, in the event of connecting the stubs alternately as in the high-frequency switch 70, the intervals between the stubs can be made even more narrow than with an arrangement wherein stubs are connected only on one side, so even further reduction in size of the high-frequency switch can be realized.

While the above embodiments have described an example of a so-called SPST (Single Pole Single Throw, one-on-one) switch wherein a signal between two terminals is either conducted or cut off, using a plurality of the high-frequency switches according to the present invention enables a so-called SPxT (Single Pole x Throw, one-on-multiple) switch to be configured.

Figure 17:
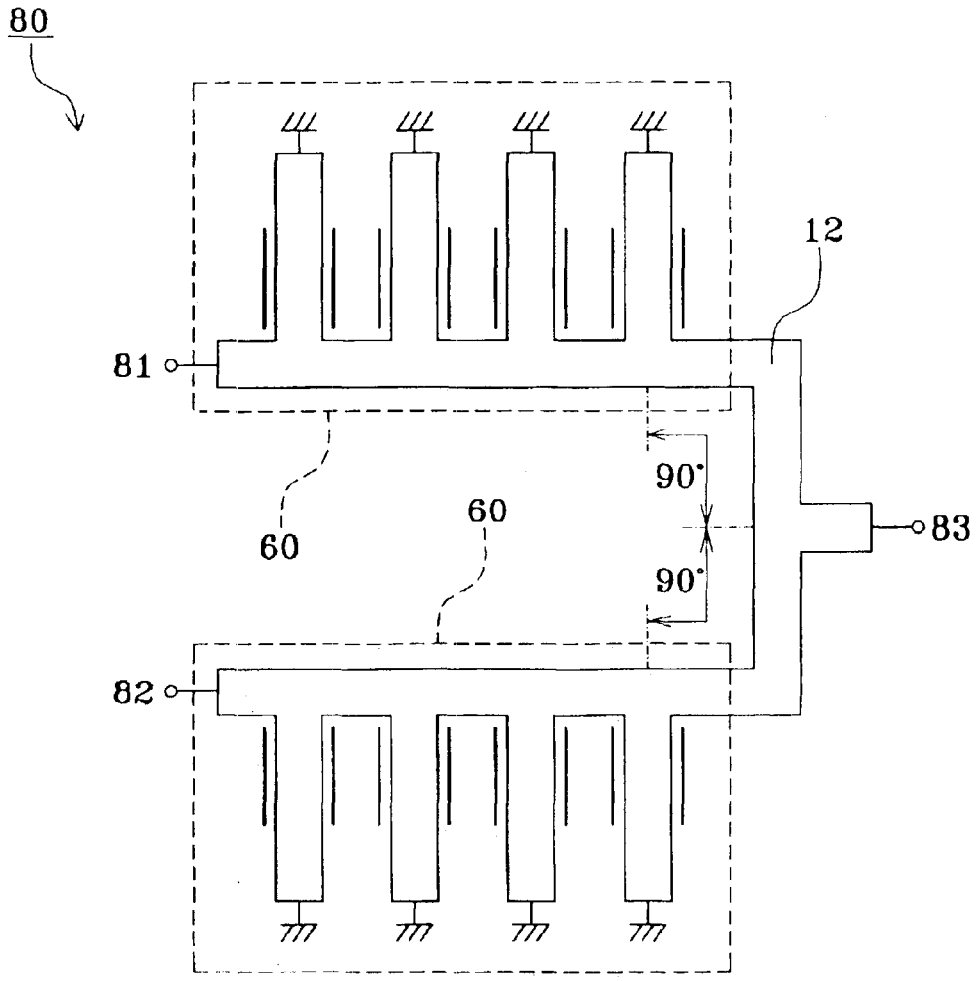
FIG. 17 is a plan view illustrating yet another embodiment of the high-frequency switch according to the present invention.

FIG. 17 shows a schematic diagram of yet another embodiment of the high-frequency switch according to the present invention. FIG. 17 is a simplified diagram to show only certain features, and the parts which are the same as or equivalent to those in FIG. 1 are denoted with the same reference numerals and description thereof will be omitted.

In the high-frequency switch 80 shown in FIG. 17, two of the high-frequency switches 60 shown in FIG. 14 are used, with the ends thereof connected to form a third terminal. In FIG. 17, one end of one high-frequency switch 60 is connected to a terminal 81, one end of the other high-frequency switch 60 is connected to a terminal 82, and the other ends of both of the two high-frequency switches 60 are connected to each other and also connected to a terminal 83. The length of the main line electrode 12 from the contact point to the connecting point of the stub line electrode closest to each high-frequency switch 60 is set so as to be approximately 90° in electrical length as to the high-frequency signals.

With the high-frequency switch 80 configured thus, each high-frequency switch 60 acts as a low-loss switch. Moreover, the length of the main line electrode 12 from the contact point to the connecting point of the stub line electrode closest to each high-frequency switch 60 is set so as to be generally 90° in electrical length as to the high-frequency signals, so in the event that one high-frequency switch 60 is on and the other high-frequency switch 60 is off, the high-frequency switch 60 in the off state appears to have infinite impedance to the main line electrode 12. That is to say, this is the same as if the high-frequency switch 60 in the off state did not exist. This allows a SPDT (Single Pole Double Throw, one-on-two) switch to be realized with little unconformity and insertion loss upon switching on.

Note that while the length of the main line electrode 12 from the contact point between two high-frequency switches 60 to the connecting point of the stub line electrode closest to each high-frequency switch 60 is set to be approximately 90° in electrical length as to the high-frequency signals to be carried, this is with regard to an ideal case wherein the resistance value between the FET of each stub in the on state and the ground is sufficiently small. In reality, cases wherein the length of the main line electrode 12 of this portion is approximately 80° in electrical length may be conceived.

Note that while an SPDT switch is realized with the high-frequency switch 80, an SPxT switch can be configured in the same way using three or more high-frequency switches 60, for example.

Now, the above embodiments have the structure of the high-frequency switch 10 shown in FIG. 1 as the basic structure thereof. With the high-frequency switch 10, in the event of turning off the switch, i.e., in the event of the FET portion turning on, the DC potential of the gate is set to 0 V which is the same as the drain and source, so there is no bias applied to the gate as to the drain and source. However, even in a state without bias the depletion layer exists. Accordingly, further reducing the depletion layer by forward bias of the gate as to the drain and source, can be conceived.

Figure 18:
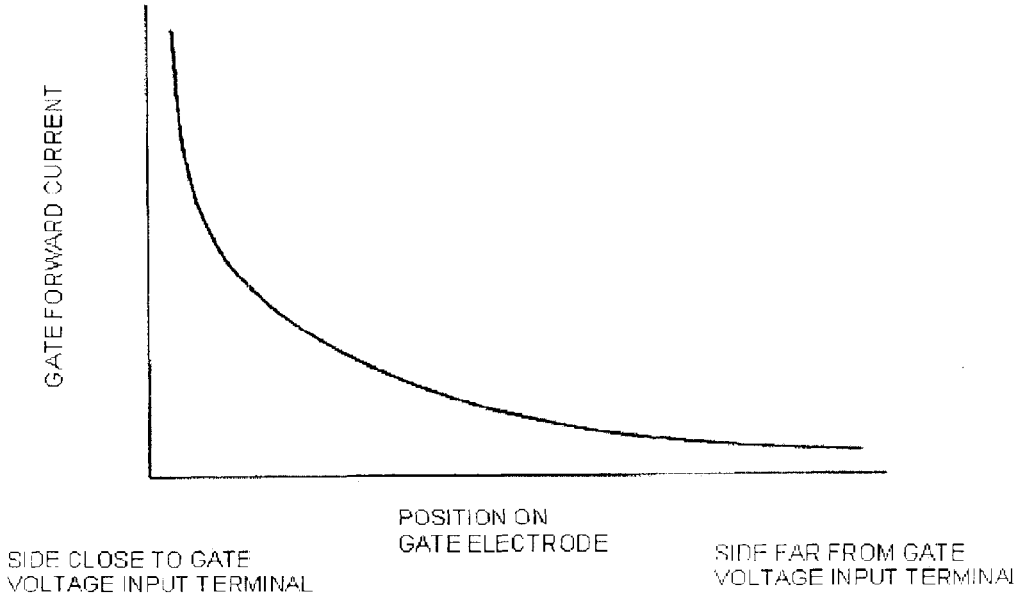
FIG. 18 is a properties diagram illustrating the relation between the position on the gate electrode and the gate forward current.

Forward bias of the gate as to the drain and source causes a gate current to flow. In the event that the gate width is long, there is difference in potential between positions near the gate voltage input terminal and positions far away therefrom, due to resistance of the gate electrode. Consequently, as shown in FIG. 18, there is a tendency that the potential difference with the drain and source increases the closer to the gate voltage input terminal, and the gate forward direction current also increases. The greater the gate forward direction current is, the smaller the depletion layer is, and accordingly, the smaller the resistance between the drain and source is. Applying this to the high-frequency switch 10, the on resistance Ron of the FET portion per increment length of the stub line electrode 15 is greater at one end side of the stub line electrode 15 (the side connected to the main line electrode 12) and smaller at the other end side. This is not ideal from the point of view of the present invention which states that grounding at least one end of the stub line electrode 15 with a sufficiently low resistance value is sufficient.

Figure 19:
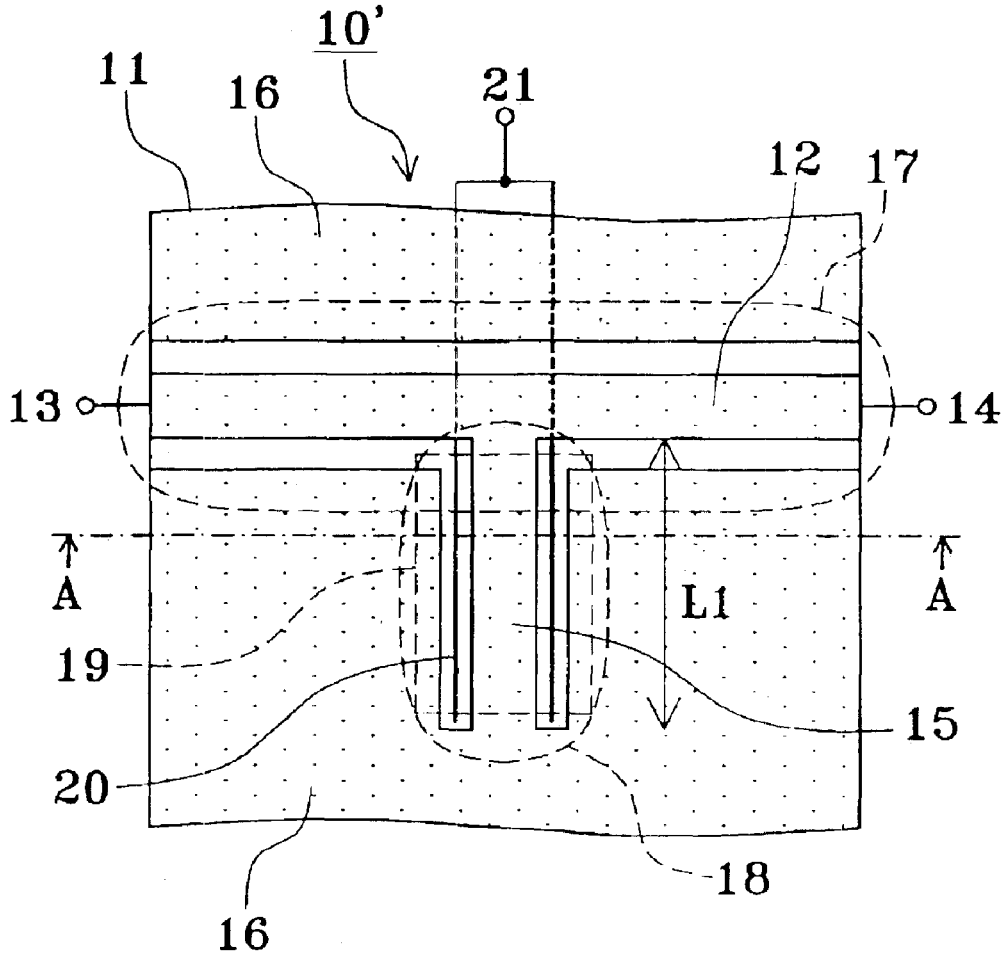
FIG. 19 is a plan view illustrating yet another embodiment of the high-frequency switch according to the present invention.

Accordingly, FIG. 19 shows a plan diagram of yet another embodiment of the high-frequency switch according to the present invention, with this point improved. In FIG. 19, the parts which are the same as or equivalent to those in FIG. 1 are denoted with the same reference numerals and description thereof will be omitted. The cross-sectional view of the FET portion is the same as that in FIG. 2, and accordingly will be omitted.

With the high-frequency switch 10' shown in FIG. 19, the only difference from high-frequency switch 10 is that the gate electrodes 20 are extended from one end of the stub line electrode 15 and connected to the gate voltage input terminal 21. With this gate electrode extracting configuration, the wiring from the gate electrodes 20 to the gate voltage input terminal 21 partially overlaps the main line electrode 12 and ground electrode 16, but these are insulated by one straddling another via an air bridge structure, introducing an insulating layer therebetween or the like.

With the high-frequency switch 10' thus configured, setting the DC potential of the drain and source (the stub line electrode 15 and ground electrode 16) to 0 V and further setting the DC potential of the gate electrode 20 to +1 v for example, the gate is in a forward bias state as to the drain and source, and the depletion layer 22 becomes smaller, so the drain and source are approximately short-circuited along the entire length of the stub line electrode 15 in the longitudinal direction, via the semiconductor activation layer 19.

Moreover, in the event of the gate having forward bias as to the drain and source, the on resistance Ron of the FET portion per increment length of the stub line electrode 15 is smaller the closer to the gate voltage input terminal as described above, so with the high-frequency switch 10', the closer to one end side of the stub line electrode 15, the better a short-circuit state can be obtained. Accordingly, with the high-frequency switch 10', an off state can be realized better than with the high-frequency switch 10. Note that in the on state of these switches, the gate is in an inverse bias state as to the drain and source, so there is no difference in the properties of the high-frequency switches 10 and 10'.

Thus, using the structure of the high-frequency switch 10' allows the cut-off properties to be improved when switching off. This structure improves the short-circuiting state at one end side of the stub line electrode, and accordingly can be used in the same way as with the high-frequency switch 30 shown in FIG. 8, yielding the same advantages.

Also, using this gate electrode extracting configuration allows the cut-off properties when switching off to be improved per stub line electrode, so properties can be improved with switches using multiple stub line electrodes. That is to say, in the event of using the configuration for gate electrode extracting according to the high-frequency switch 10' with the high-frequency switch 60 shown in FIG. 14 for example, the same isolation properties can be obtained with a smaller number of stub line electrodes. Reducing the number of stub line electrodes means that the area of the high-frequency switch can be reduced. Also, reducing the number of stub line electrodes means that the insertion loss when switching on can be reduced. This advantage is not limited to only SPST switches such as the high-frequency switches 10 and 60, but rather, the same advantages can be obtained with SPxT switches including SPDT switches such as the high-frequency switch 80 shown in FIG. 17.

Figure 20:
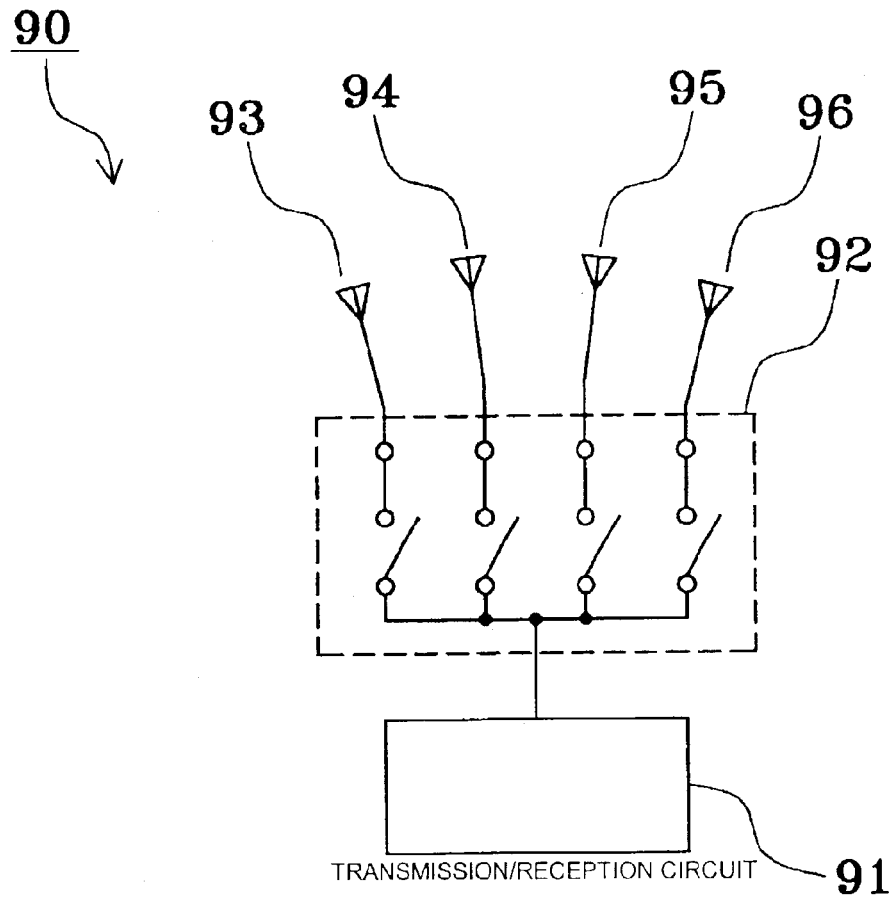
FIG. 20 is a block diagram illustrating an embodiment of the electronic device according to the present invention.

Finally, FIG. 20 is a block diagram illustrating an embodiment of an electronic device according to the present invention. In FIG. 20, the electronic device 90 is a radar device, comprising a transmission/reception circuit 91, the high-frequency switch 92 according to the present invention, and four antennas 93, 94, 95, and 96. Of these, the high-frequency switch 92 is a single-input four-output high-frequency switch with four high-frequency switches built in, configured such that each built-in switch turns on in order, and one of the antennas is connected with the transmission/reception circuit 91 via the built-in switch in the on state, thereby transmitting and receiving signals. The respective orientations of the four antennas 93, 94, 95, and 96 differ, and accordingly can operate as a radar in four directions by switching over the built-in switches in the high-frequency switch 92.

Thus, with the electronic device 90 configured as described above, using the high-frequency switch 92 according to the present invention allows loss of signals to be reduced due to the small insertion loss when switching on, thereby reducing electric power consumption. Also, the excellent cut-off properties when switched off prevents malfunctioning such as emitting radar waves in the wrong direction or detecting objects in the wrong direction.

While FIG. 20 shows a radar device as an example of the electronic device, the present invention is by no means restricted to radar devices, but rather, the present invention can be applied to any electronic device using the high-frequency switch according to the present invention.

Although the present invention has been described in relation to particular embodiments thereof, many other variations and modifications and other uses will become apparent to those skilled in the art. Therefore, the present invention is not limited by the specific disclosure herein.

What is claimed is:

1. A high-frequency switch, comprising:

a substrate having thereon a main line electrode provided between two terminals, said main line electrode having a pair of opposed side edges;

a stub line electrode having a width direction and a longitudinal direction, with one end thereof connected to a side edge of said main line electrode and the other end thereof grounded; and a ground electrode provided adjacent to said stub line electrode in the width direction thereof;

wherein said substrate has a semiconductor activation layer which extends below at least part of said stub line electrode and said ground electrode, between at least one side edge of said stub line electrode and said ground electrode;

and wherein a gate electrode which extends in the longitudinal direction of said stub line electrode is provided on said semiconductor activation layer between said stub line electrode and said ground electrode, thereby forming an FET structure.

2. A high-frequency switch according to claim 1;

wherein said semiconductor activation layer extends from one end to the other end of said stub line electrode.

3. A high-frequency switch, comprising:

a substrate having thereon a main line electrode provided between two terminals, said main line electrode having a pair of opposed side edges;

a stub line electrode having a width direction and a pair of opposed side edges extending in a longitudinal direction, with one end thereof connected to a side edge of said main line electrode and the other end thereof grounded; and a ground electrode provided adjacent to said stub line electrode in the width direction thereof;

wherein said substrate has a semiconductor activation layer which extends below at least part of said stub line electrode and said ground electrode, between both side edges of said stub line electrode and said ground electrode;

wherein gate electrodes which extend in the longitudinal direction of said stub line electrode are provided on said semiconductor activation layer between said stub line electrode and said ground electrode, thereby forming FET structures;

whereby said FET structures are formed at both side edges of said stub line electrode.

4. A high-frequency switch according to claim 1, wherein said stub line electrode forms a coplanar waveguide along with said ground electrode.

5. A high-frequency switch according to claim 1, wherein said stub line electrode is formed so as to have electrical length of approximately 90° with respect to the high-frequency signals to be applied.

6. A high-frequency switch according to claim 1, wherein a plurality of said stub line electrodes with corresponding said FET structures are connected to said main line electrode.

7. A high-frequency switch according to claim 6, wherein at least one of said stub line electrodes with a corresponding said FET structure is connected to each of said opposed side edges of said main line electrode in an opposing manner.

8. A high-frequency switch according to claim 6, wherein a plurality of said stub line electrodes with comprising said FET structures are connected to one side edge of said main line electrode with a predetermined gap therebetween with regard to the longitudinal direction of said main line electrode.

9. A high-frequency switch according to claim 8, wherein said gap between said stub line electrodes is of electrical length approximately 90° with regard to the high-frequency signals to be applied in the longitudinal direction of said main line electrode.

10. A high-frequency switch according to claim 6, wherein a plurality of said stub line electrodes with comprising said FET structures are connected to each side edge of said main line electrode with predetermined gaps therebetween with regard to the longitudinal direction of said main line electrode.

11. A high-frequency switch comprising a plurality of high-frequency switches according to claim 1, wherein respective ends of said plurality of high-frequency switches are connected to each other at a contact point via a main line electrode, said main line electrode having an electrical length of approximately 90° as to high-frequency signals to be carried, between the contact point and the closest stub line electrode having an FET structure of each respective said high-frequency switch.

12. A high-frequency switch according to claim 1, wherein said gate electrode is connected to a gate terminal on the opposite side of said main line electrode from said stub line electrode.

13. A high-frequency switch according to claim 1, wherein said gate electrode is extended away from said main line electrode for being connected to a gate terminal.

14. An electronic device, comprising the high-frequency switch according to claim 1.

15. An electronic device according to claim 14, further comprising a communications circuit connected to said high-frequency switch.

16. An electronic device according to claim 15, further comprising an antenna connected to said high-frequency switch.

* * * * *